US005878570A

United States Patent [19]

Reithofer

[11] Patent Number: 5,878,570

[45] Date of Patent: Mar. 9, 1999

[54] APPARATUS FOR OPERATING AND CONTROLLING A FREE-PISTON STIRLING ENGINE

[76] Inventor: Klaus Reithofer, Erlenstrasse 11a, CH-9400 Rorschacherberg, Switzerland

[21] Appl. No.: 727,455

[22] PCT Filed: Apr. 7, 1995

[86] PCT No.: PCT/EP95/01294

§ 371 Date: Jan. 6, 1997

§ 102(e) Date: Jan. 6, 1997

[87] PCT Pub. No.: WO95/29334

PCT Pub. Date: Nov. 2, 1995

[30] Foreign Application Priority Data

Apr. 23, 1994 [DE] Germany ..... 44 14 257.9

[51] Int. Cl.[6] ..... F01B 29/10

[52] U.S. Cl. ..... 60/520

[58] Field of Search ..... 60/517, 520, 525

[56] References Cited

U.S. PATENT DOCUMENTS

Re. 30,176 12/1979 Beale ..... 60/520

2,596,057 5/1952 Heeckeren et al. .

3,115,016 12/1963 Hogan ..... 60/525

FOREIGN PATENT DOCUMENTS 1065984 6/1954 France .

4219583 12/1993 Germany .

764120 12/1956 United Kingdom .

*Primary Examiner*—Noah P. Kamen

*Attorney, Agent, or Firm*—Bachman & LaPointe, P.C.

[57] ABSTRACT

Apparatus for operating and controlling a free-piston Stirling engine with a displacement piston in a cylinder, said piston separating a hot cylinder space from a cold cylinder space, an annular space being formed between the cylinder and a sleeve section surrounding the cylinder, characterized in that the annular space extends right through from an annular gap in the region of the hot cylinder space to an annular gap in the region of the cold cylinder space, plates being inserted all the way along in the longitudinal direction into this annular space.

32 Claims, 5 Drawing Sheets

APPARATUS FOR OPERATING AND CONTROLLING A FREE-PISTON STIRLING ENGINE

BACKGROUND OF THE INVENTION

The invention relates to an apparatus for operating and controlling a free-piston Stirling engine with a displacement piston in a cylinder, said piston separating a hot cylinder space from a cold cylinder space, and a method therefor.

Depending on the type of energy supplied, Stirling engines can be operated as heat engines or refrigerating machines or heat pumps. A comprehensive overview of the prior art as regards Stirling engines is provided by the dissertation of Martin Werdich, which was published in 1990 as a book with the title "Stirling-Maschinen" [Stirling engines] by Ökobuch Verlag, Staufen bei Freiburg, with the ISBN No. 3-922964-35-4.

All Stirling engines have an enclosed working medium, generally consisting of air, hydrogen or helium. The Stirling engine operates on the following principle: the working medium is pushed backwards and forwards cyclically by a displacement piston from a space at low temperature, via a cooler, regenerator and heater, into a space at a higher temperature level. The pressure differences which arise in this process serve to drive the working piston, which is normally moved with a phase shift of 90° relative to the displacement piston. Driving the displacement piston requires little energy since the pressure on both sides of the piston is virtually the same. The work of the displacement piston here corresponds merely to that required to overcome the gas friction during cyclic flows of the working medium through the heat exchanger and the regenerator. The displacement piston is generally driven by a crankshaft driven by the working piston. In the case of the free-piston engines, the mechanical elements which lead to the outside, such as the connecting rod, pushrod and crankshaft are replaced by internal spring-mass oscillatory systems.

The known free-piston Stirling engines do not have a mechanical connection between the working piston and the displacement piston. The two pistons can move freely.

The springs are often designed as gas-filled springs. From a state of unstable equilibrium, the pistons begin to oscillate and excite one another even in the presence of small temperature changes and the resulting change in pressure.

The main advantages of free-piston engines lie, on the one hand, in their very simple construction—they comprise just two moving parts—and, on the other hand, in the absence of any lateral guiding forces on the piston, and the avoidance of all sealing problems.

The converted energy can, for example, be transmitted to the outside via an electric linear generator.

Despite these undisputed advantages of the free-piston engine, it has not established itself in practice so far.

The reason for this is the difficulty of regulating the oscillation pattern. Specifically in the case of a fluctuating energy supply or variable loading of the working piston, the amplitude of oscillation and frequency varies and cannot be controlled satisfactorily.

The object on which the present invention is based is to manufacture, operate and control a free-piston engine in a simple and cost-effective manner.

SUMMARY OF THE INVENTION

This object is achieved by virtue of the fact that an annular space, into which a plurality of plates are inserted between an annular gap and an opposite annular gap, is formed between the cylinder and a sleeve section surrounding the entire cylinder.

In the case of a free-piston Stirling engine, a system pressure between the cold and the hot cylinder space is fed into a high-pressure reservoir if a maximum value is exceeded and made up from a low-pressure reservoir if a minimum value is undershot, and the pressure difference between the high-pressure and the low-pressure reservoir is used to drive an energy converter, an auxiliary drive and/or a working piston.

The pressure fluctuations of the medium caused by the temperature differences are passed into a reservoir at high pressure via an inlet valve and into a reservoir at lower pressure through an outlet valve. The pressure difference between the two reservoirs supplies the desired driving energy.

Depending on the dimensioning of the two pressure reservoirs, the entire converted energy can be temporarily stored, and any desired expansion machine can be used to convert the pressure energy into mechanical or electrical energy instead of the working piston used in the case of conventional Stirling engines. A particularly advantageous solution is obtained for a Stirling engine for converting thermal to electrical energy, as required for combined heat and power systems. Here, the working piston can be embodied in such a way that it serves as an induction magnet for the linear generator and at the same time forms the drive for the displacement piston. This gives a motor with a generator comprising just a moving piston.

Specifically for conversion of the pressure energy in a separate expansion machine, connection of a plurality of pressure generators in parallel is furthermore suitable. This is particularly advantageous for the conversion of solar energy, when the heat is produced by a number of parabolic mirrors. It is then not necessary to equip each parabolic mirror with a complete Stirling engine but only with a pressure generator. Via the inlet valve, there is a feed into a common collecting line for high pressure, and the gas is returned from a low-pressure collecting line through the outlet valve. One central expansion machine is then sufficient for the conversion of the energy of all the heat sources.

In an apparatus for carrying out the method, i.e. for operating and controlling a free-piston Stirling engine with a displacement piston in a cylinder, said piston separating a hot cylinder space from a cold cylinder space, the hot cylinder space should be connected to the cold cylinder space by a system pressure line. From the system pressure line, a pressure line leads to the low-pressure reservoir and the high-pressure reservoir. In a preferred exemplary embodiment of the invention, a cooler, a regenerator and a heater are furthermore inserted into the system pressure line. The essential point is that the pressure line can be shut off in the direction of the high-pressure reservoir by means of an inlet valve which is designed in such a way that pressure from the high-pressure reservoir cannot get back into the pressure line. This means that the valve opens only in the direction of the high-pressure reservoir, this only occurring when the pressure in the pressure line is above that in the high-pressure reservoir.

In the direction of the pressure line, the low-pressure reservoir likewise has an outlet valve, which is designed in such a way that it opens only when the pressure in the pressure line or in the system pressure line is below that in the low-pressure reservoir. The maximum possible pressure difference between the high-pressure reservoir and the low-pressure reservoir is thereby achieved. An energy converter, a working piston or an auxiliary drive is driven by means of this pressure difference.

To ensure that this takes place in a controlled manner, a valve is provided, and all possible types of valve are conceivable here. The valve can be controlled electrically, mechanically or, as in the present exemplary embodiment, pneumatically. The valve takes the appropriate form for this purpose so as, in accordance with the specification, to supply one or the other side of the working piston, auxiliary drive or the like with pressure.

A free-piston engine for use with the method and apparatus according to the invention is a very compact construction. Both the displacement piston and working piston and the heater, regenerator and cooler are integrated into one body. The corresponding preferred embodiment is described in the present specification. Apart from its compact construction, it has the advantage that the piston rod for connecting the displacement piston and the working piston is mounted in the cold cylinder space or cooler, allowing the use of plastic bearings for dry and low-friction running.

The displacement piston is furthermore dimensioned in such a way that it does not touch the cylinder walls, and hence no mechanical friction is produced. For this reason, it is possible to dispense with an additional lubricant.

The heater deserves special attention. It is suitable, for example, as the center of a solar collector, so that it has a very high efficiency. The spiral arrangement of the channels in the heater ensures long paths and hence a large heat exchanger surface area. At the periphery of the heater plate, all the channels lead to an annular conduit, which in turn establishes a very short connection to the regenerator. The same applies also to the connection between the regenerator and the cooler and between the cooler and the cold cylinder space. There is a flow of cooling water, or of returning heating water in the case of a combined heat and power system, around the cooling lines themselves.

In another exemplary embodiment of the present invention, an apparatus according to the invention is shown in which a displacement piston, preferably of thin-walled design, runs in a cylinder. Here, the displacement piston is designed as a closed hollow body and is provided close to a pushrod with a valve, in particular a pressure relief valve. Via the valve, there is the possibility of supplying an interior space of the displacement piston with maximum pressure, the supply of pressure being effected by moving the piston backwards and forwards in a cylinder, in particular by means of the overpressure produced in the displacer space, to ensure that the latter has a higher rigidity.

Consideration is also given to making the wall of the displacement piston particularly thin so that the displacement piston has a low inertia and high oscillation frequencies or frequencies of motion are possible as a result.

The pushrod is connected to a working piston, the latter likewise being movable backwards and forwards in another cylinder. Instead of the working piston, it is also possible for other driving and control elements such as, for example, generators or the like, to be connected to the pushrod by means of additional connecting rods and shafts or the like.

The cylinder is surrounded by a spaced sleeve section, giving rise to an annular space according to the invention between an outer wall of the cylinder and an inner wall of the sleeve section. The sleeve section is provided at one end with a cover and at the other end is closed by a cap, into which various connections pass directly near to the cap. One of the two connections is provided with an inlet valve and leads to a high-pressure reservoir, while the other connection is provided with an outlet valve which leads to a low-pressure reservoir.

Arranged around the outer wall of the sleeve section, near to the cap, is a cooler which partially surrounds the outer wall of the sleeve section, spirally arranged cooling ribs increasing a cooling effect of the sleeve section. The cooling ribs and, in particular, the cooler are manufactured from materials which are very good heat conductors. Adjoining the cooler, in particular the remaining part of the sleeve section, the remaining part of the sleeve section from an end wall forms, together with the adjoining cover, a heater. The heater or cover and said part of the sleeve section are supplied with heat, thus ensuring a heat transfer from the sleeve section to the annular space.

The sleeve section, particularly in the region of the heater, is provided with heat-conducting disks which are arranged one above the other on the surface of the sleeve section. The heat-conducting disk has ribbed blades which are arranged around a circular ring and which are arched slightly in a manner similar to turbine blades or the like in order to remove the maximum possible energy from the heat flow flowing past.

The heat-conducting disk is here provided with clamping strips, in particular in the interior of the circular ring, by means of which the heat-conducting disk is pushed onto the outer surface of the sleeve section and clamped on it. The heat-conducting disks are surrounded by a jacket so that the heat flow has to flow from the cover through the heat-conducting disks and a large heat transfer is thereby achieved. By virtue of the fact that the heat-conducting disks are arranged in a slightly offset or rotated manner relative to one another on the sleeve section, the heat flow travels a long path and this likewise leads to increased heat transfer.

A gas likewise flows through the annular space according to the invention, between the displacer space and the cylinder space, in that the gas or the like can flow from an annular gap close to the displacer space to an annular gap of the cylinder space and back in the opposite direction.

In order to obtain the maximum possible heat exchange with the gas flowing along, plates according to the invention are inserted into the annular gap in the longitudinal direction or in the direction of motion of the piston, between the two annular gaps, a gap which carries the gas or the like and at the same time transfers heat to it being formed between two adjacent plates.

The plates according to the invention essentially comprise two profiles, which are connected to one another by a strip. The decisive factor here is that for annular spaces of round design, in particular, a multiplicity of plates is required to fill these spaces completely. To ensure that the preferably round annular spaces are provided uniformly with plates, one of the two profiles is made thinner. A radius of the annular gap can thus be compensated for by the plates, it being possible for a plurality of plates to be laid one above the other and the gap being formed in a precisely defined manner between them and between the adjacent strips.

The profiles, which are preferably of triangular configuration, are furthermore arranged symmetrically with respect to the top and bottom sides of the plates above and below them, and radial displacement or slippage within the annular space is not possible. As a result, the gap is held constant and an exact, precisely definable and calculatable volume flow can flow through the gap with a large heat exchange surface area.

Making it possible to lay plates one above the other by means of different profiles, for example round shapes or angled shapes, is also within the scope of the invention.

The essential advantage of the plate arrangement is that the plates extend in the longitudinal direction or in the direction of motion of the displacement piston over the entire length of the annular space, and a large heat exchange surface area is thus formed between the cylinder wall and the sleeve section.

A further advantage is that the plates, which are preferably manufactured from a material of high thermal conductivity, can be manufactured easily and therefore in large numbers.

BRIEF DESCRIPTION OF THE DRAWINGS

Further advantages, features and details of the invention will emerge from the following description of preferred exemplary embodiments and from the drawings, in which.

DETAILED DESCRIPTION OF PREFERRED EMBODIMENTS

Figure 1:
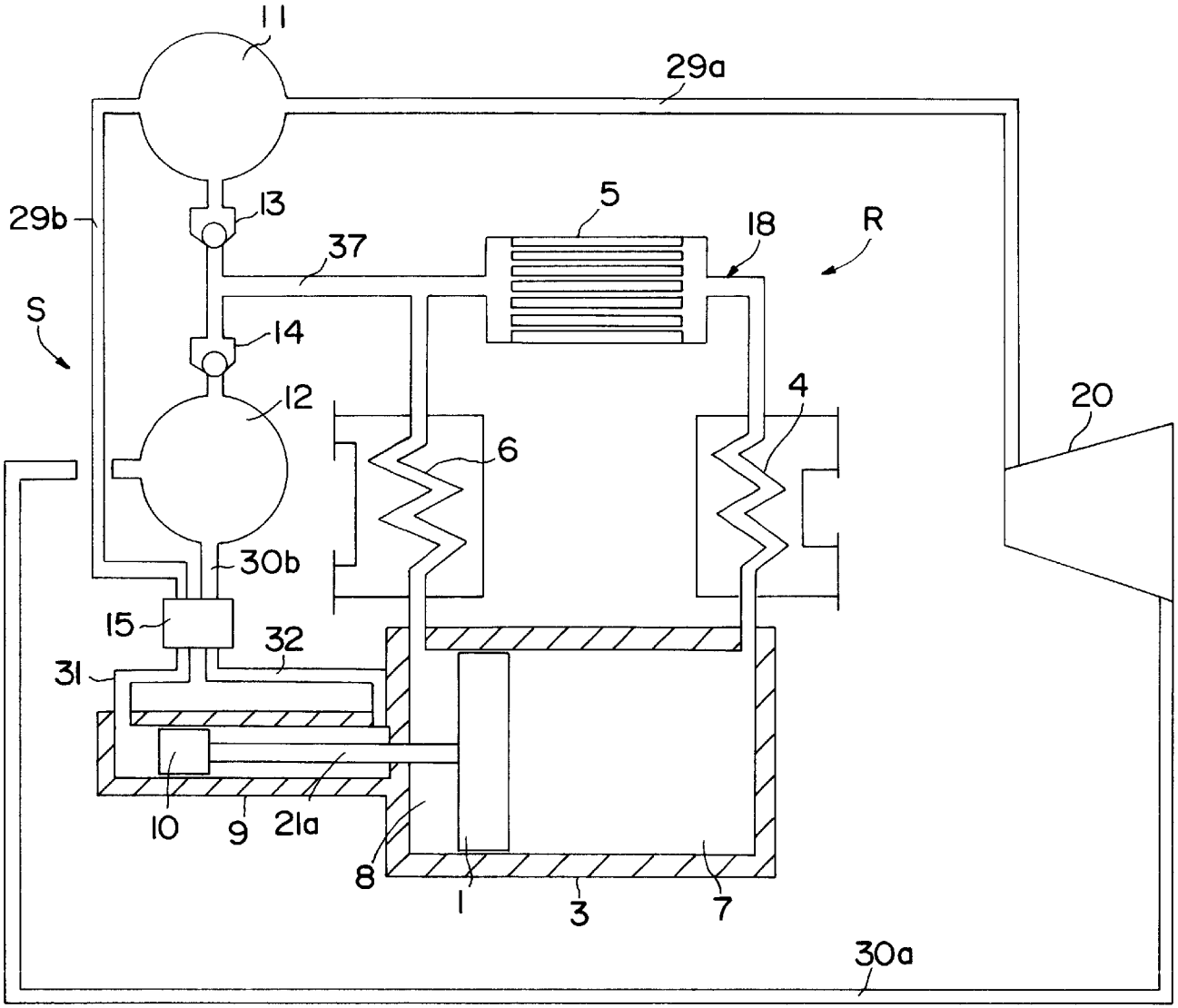
FIG. 1 shows a partial longitudinal section and a partially schematic representation of a free-piston engine with control system.

FIG. 1 shows a free-piston engine R for the production of pressure and mechanical energy with a control system S according to the invention for a displacement piston 1 provided by an auxiliary drive 10, in a cylinder 9, which draws energy from pressure reservoirs 11 and 12 that are connected via inlet and outlet valves 13, 14 to a system pressure line 18 of the free-piston engine R.

The displacement piston 1 of the free-piston engine R is seated in a cylinder 3 and is coupled to the auxiliary drive 10 by a pushrod 21*a*. Inserted into the system pressure line 18 there are, starting from a hot cylinder space 7 of the cylinder 3, a heater 4 and, following this in series, a regenerator 5 and a cooler 6, after which the system pressure line 18 opens into a cold cylinder space 8 of the cylinder 3. A common pressure line 37 branches off from the system pressure line 18 to the inlet and outlet valves 13, 14 between the regenerator 5 and the cooler 6.

The inlet valve 13 is assigned to the high-pressure reservoir 11. Leading off from the latter is a line 29*a*, designed as a high-pressure line, to an energy converter 20, which is connected, on the other side, to the low-pressure reservoir 12 by a low-pressure line 30*a*.

Lines 29*b* and 30*b* are likewise designed as a high-pressure line and a low-pressure line respectively, these lines starting from the high-pressure reservoir 11 and the low-pressure reservoir 12, respectively, and opening into a valve 15. The valve 15 is connected to the cylinder 9 in such a way by lines 31 and 32 that the line 32 from the low-pressure reservoir 12 is connected to the cylinder 9 and opens into a corresponding pressure chamber on the right-hand side of the auxiliary drive 10 and the line 31 from the high-pressure reservoir 11 is connected to the cylinder 9 and opens into a corresponding pressure chamber on the left-hand side of the auxiliary drive 10.

If, in the exemplary embodiment under consideration, in accordance with FIG. 1, the displacement piston 1 is displaced towards the left in the cylinder 3, gas flows out of the cold cylinder space 8 through the cooler 6, the regenerator 5 and the heater 4 with a continuous increase in temperature into the hot cylinder space 7 of the cylinder 3. During this process, the gas pressure rises in proportion to the volume percentage of the hot gas. It reaches the highest value when all the gas has been displaced into the hot cylinder space 7. During the movement of the displacement piston 1 in the opposite direction, the hot gas is pushed back into the cold cylinder space 8 of the cylinder 3 through the heater 4, the regenerator 5 and the cooler 6 with a continuous reduction in temperature and reduction in pressure.

The reservoir 11 in the form of a high-pressure reservoir is connected to the system pressure line 18 between the cooler 6 and the regenerator 5 by the inlet valve 13. If a system pressure in this line 18 is higher than that in the pressure reservoir 11, the inlet valve 13 opens and the high-pressure reservoir 11 is charged up to the maximum value of the system pressure. If the system pressure falls, the inlet valve 13 closes and prevents the gas from flowing back out of the high-pressure reservoir 11.

If the system pressure in the system pressure line 18 falls below a pressure of the reservoir 12 designed as a low-pressure reservoir, the outlet valve 14 and the low-pressure reservoir 12 can be discharged down to a minimum value of the system pressure. If the system pressure rises above that in the low-pressure reservoir 12, the outlet valve 14 prevents the low-pressure reservoir 12 from being charged up. In this way there arises a pressure potential between the high-pressure reservoir 11 and the low-pressure reservoir 12 which can be converted by means of the energy converter 20, for example a compressed-air motor, turbine or cylinder with a working piston, into mechanical energy.

These sequences take place in a system which is completely closed off from the outside. Energy is supplied exclusively in the form of heat via the heater 4.

That fraction of the thermally supplied energy which cannot be converted, and part of the regenerator loss, is dissipated via the cooler 6. This cooler 6 is ideally suited to combining heat and power since the efficiency of energy conversion is all the higher, the lower the temperature of the cold gas falls.

The essential point with the present invention is the method of pressure generation and storage in high- and low-pressure reservoirs 11, 12 and control by means of valve 15, which controls the auxiliary drive 10 via lines 31 and 32. A clearer, more detailed description of the control and mode of operation of the apparatus by means of valve 15 and auxiliary drive 10 will be given with reference to FIG. 2.

Figure 2:
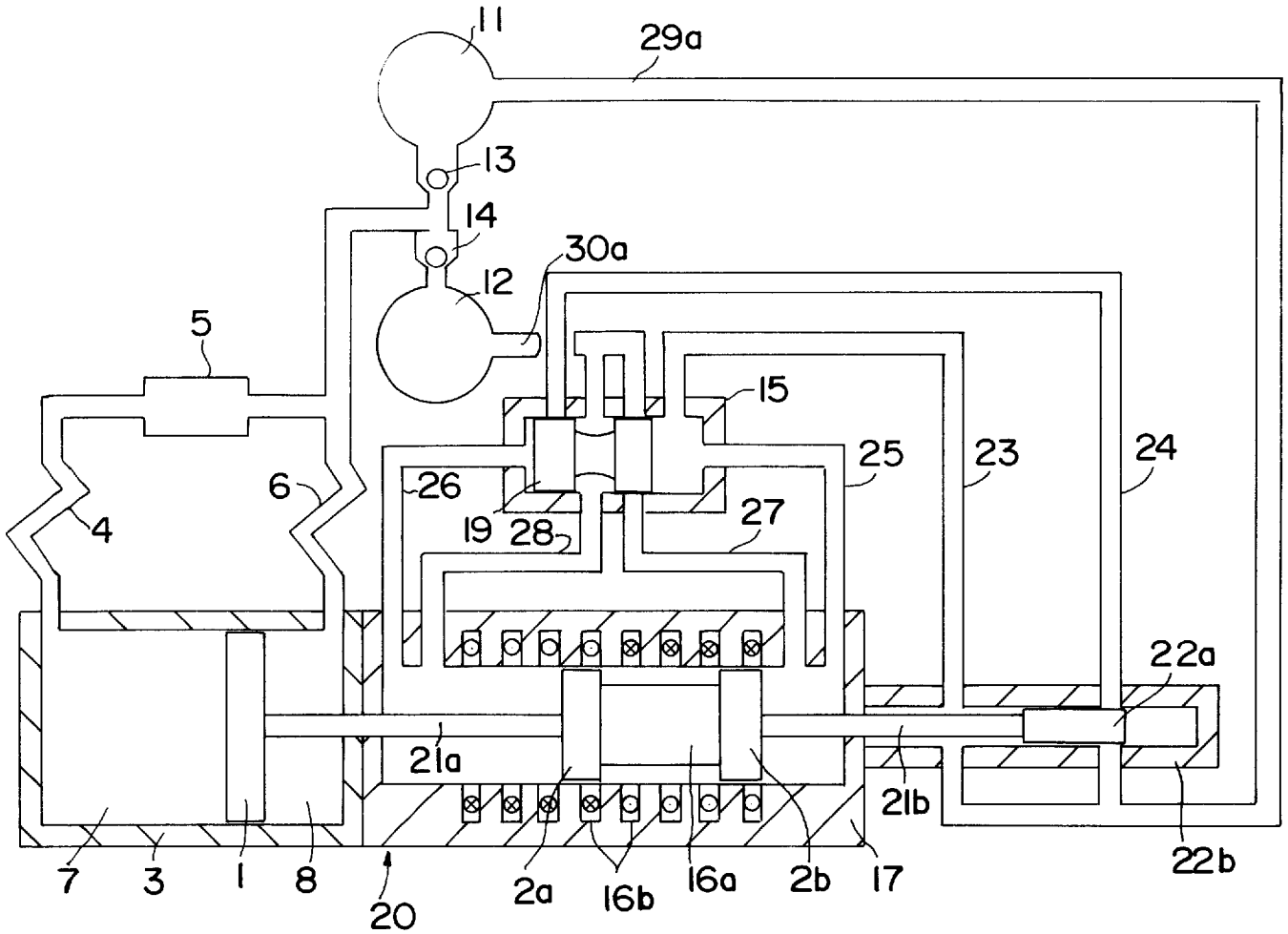
FIG. 2 shows a partial longitudinal section and a partially schematic representation of a further exemplary embodiment of a free-piston engine with control system.

FIG. 2 shows the preferred embodiment of a free-piston (Stirling) engine for converting thermal energy into electrical energy with two working pistons 2*a* and 2*b*, which are coupled to the displacement piston 1, which is arranged displaceably in the cylinder 3, by the pushrod 21*a*. The arrangement of the displacement piston 1, the cylinder 3, the cooler 6, the heater 4, the regenerator 5, the high-pressure and the low-pressure reservoir 11 and 12 and the inlet and outlet valves 13 and 14 has already been described in FIG. 1.

The working pistons 2*a* and 2*b* are located in a cylinder 17, to which at least one inductive coil 16*b*, arranged in accordance with the polarity of a magnet, is assigned. An induction magnet 16*a* with a different polarity, mounted between the working pistons 2*a* and 2*b* is provided within the cylinder 17.

The working pistons 2*a* and 2*b* are furthermore coupled, by another pushrod 21*b*, to a shut-off slide 22*a* , attached to the end of the latter, which is located in a cylinder 22*b* to which a split high-pressure line 29*a*, starting from the high-pressure reservoir 11, and two pressure feed lines 23 and 24 are connected, the latter opening into a valve 15 with an integrated movable spool 19.

The low-pressure reservoir 12 is connected to the valve 15 by a split low-pressure line 30*a*. Pressure feed lines 25 and 26 and low-pressure return lines 27 and 28 lead from this valve 15 to the cylinder 17 on both sides of the working pistons 2.

The present invention as shown in FIG. 2 operates as follows:

The components of the working pistons 2*a* and 2*b*, cylinder 17, induction magnets 16*a* and coil 16*b* together form an energy converter 20. Since the working pistons 2*a* and 2*b* are also provided with the induction magnet 16*a*, a voltage is induced in the coil 16*b* by the backward and forward movement of the working piston 2*a* and 2*b*. A motor-generator unit is thus formed from a minimum of moving parts.

In this embodiment, the movement of the working pistons 2*a* and 2*b* is controlled directly by the valve 15 and by means of a pneumatically actuated shut-off slide 22*a*, which is coupled to the working pistons 2 by a pushrod 21*b*. In the position shown in FIG. 2, gas flows out of the high-pressure reservoir 11, through line 29*a* and the pressure feed line 23, to the valve 15, which directs the pressure via line 25 to the right-hand side of the energy converter 20.

Since, at the same time, the left-hand side of the energy converter 20 is connected to the low-pressure reservoir 12 via the low-pressure return line 28 and the valve 15, the working pistons 2*a* and 2*b* can be displaced to the left with the full pressure difference until the shut-off slide 22*a* blocks the pressure feed line 23 leading to the valve 15. The working pistons 2*a* and 2*b* are then displaced further to the left by the expansion of the gas in the right-hand part of the energy converter 20, with the pressure falling simultaneously, until working piston 2*a* shuts off the return line 28, giving rise to a back pressure which, by virtue of the inertia forces, exceeds the pressure on the right-hand side of the cylinder and pushes the spool 19 to the right-hand side via line 26. The spool remains in this position because of interlinking by virtue of the fact that the pressure feed line 24 has in the meantime been freed, until the same cycle is repeated in the opposite direction. In this process, pressure is supplied to the left-hand side of the working pistons 2*a* and 2*b* via the pressure feed line 24 and the low-pressure return line 27 is free.

The same sequence of motions is achieved with even fewer components if the pneumatically controlled valve 15 is replaced by an electrically controlled four-way valve, thereby eliminating the shut-off slide 22*a* and the lines 23, 24, 25 and 26 for valve control.

Figure 3:
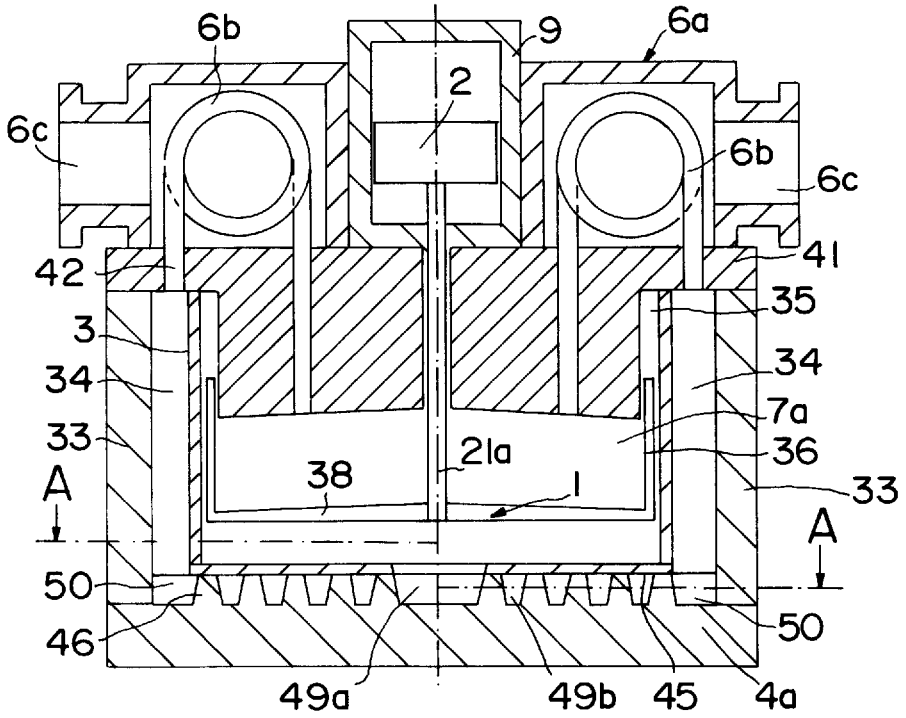
FIG. 3 shows an axial section through an embodiment according to the invention of a free-piston engine along the line B—B in FIG. 4.
Figure 4:
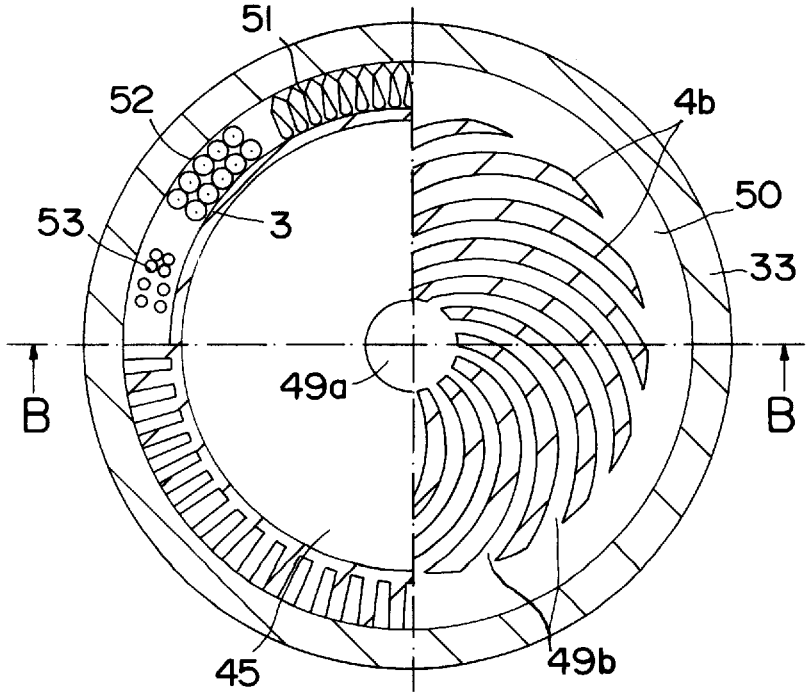
FIG. 4 shows a radial section through the free-piston engine in FIG. 3 with an offset section line A—A.

FIGS. 3 and 4 show an embodiment according to the invention of the apparatus.

Mounted on a sleeve section 33 there is, on the one side, a heater 4*a* which is shaped in the form of a cover and, on the side facing the displacement piston 1, plates which are preferably arranged in a spiral shape for optimum heat transfer. These plates lead out from the center and are covered by a disk 45. This disk has a central channel opening 49*a* and, with the plates 4*b*, forms channels 49*b* which open into an annular conduit 50. Directly adjoining the latter as a regenerator is an annular space 34, which is formed by the inner wall of the sleeve section 33 and the outer wall of the cylinder 3 and, according to FIG. 4, can contain a very wide variety of inserts such as, for example, a folded metal sheet 51, a series of thin tubes 52 or wires 53.

The annular space 34 is connected by line sections 42 which lead through a carrier 41 to at least one cooling line 6*b* which is distributed over the circumference and is wound in a coil in a cooler 6*a* associated with the carrier 41. The other ends of the cooling lines 6*b* lead back through the carrier 41 and open into a cylinder space 7*a* which lies opposite the heater 4*a* and is formed by the carrier 41, the cylinder 3 and the heater 4*a*. The cooler 6*a* can be flowed through by a medium in different directions through connections 6*c*.

The displacement piston 1 slides in the cylinder space 7*a*, the displacement piston preferably being of cagework and extremely light construction. It is connected by means of a pushrod 21*a* to a working piston 2, which is associated with the carrier 41 and is integrated into the cylinder 9. The wall 36 of the displacement piston 1 runs in an annular gap 35 which is formed between part of the inner surface of the cylinder 3 and part of the outer surface of the carrier 41. A pressure surface 38 of the displacement piston 1 can then be made very thin.

Figure 5:
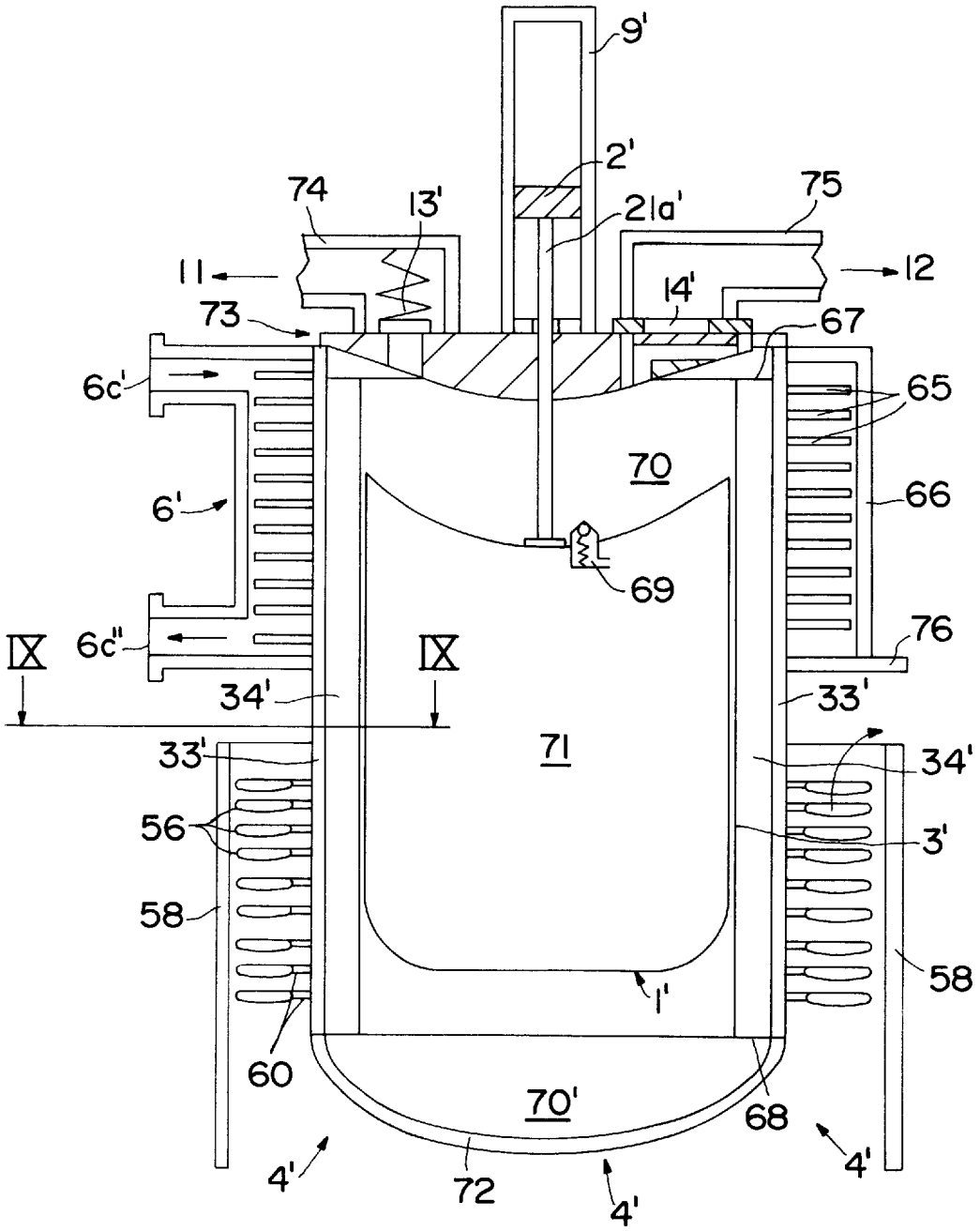
FIG. 5 shows a longitudinal section through another exemplary embodiment of the free-piston engine according to the invention.

FIG. 5 shows another embodiment according to the invention of the apparatus. Here, a displacement piston 1', preferably of thin-walled design, runs in a cylinder 3'. Close to a pushrod 21*a'*, the displacement piston 1' has a valve 69, which is designed in such a way that air or gas passes from a displacement space 70 into an interior space 71 of the displacement piston 1' when the pressure in the displacement space 70 is higher than the pressure in the interior space of the displacement piston 1'. As a result, the displacement piston 1' acquires greater stability while being of lighter construction. It is sealed off relative to a cylinder wall of the cylinder 3' by means of piston rings (not shown here).

At the other end, the pushrod 21*a'* connected to the displacement piston 1' is connected to a working piston 2', which can be moved backwards and forwards in a cylinder 9'.

Arranged around the cylinder 3', at a distance, is a sleeve section 33', giving rise to an inventive annular space 34' between an outer wall of the cylinder 3' and an inner wall of the sleeve section 33' over the entire length of the cylinder 3'. Adjoining the sleeve section 33' at one end is a cover 72 corresponding approximately to the shape of the displacement piston 1'.

At the other end, the sleeve section 33' is closed by a cap 73 into which the connections 74 and 75 engage directly. Connection 74, which has an inlet valve 13', leads directly to a high-pressure reservoir 11, while connection 75, which contains an outlet valve 14', leads to a low-pressure reservoir 12. The cylinder space 70' is formed between the displacement piston 1' and the cover 72.

Arranged around the outer wall of the sleeve section 33' quite close to the cap 73 and extending over approximately half of the sleeve section 33', is a cooler 6'. In this arrangement, the cooler 6' completely surrounds the outer wall of that part of the sleeve section so as to cool said wall.

In order to achieve a better cooling effect, cooling ribs 65 are arranged in a spiral in the cooler 6', a cooling fluid or the like flowing, preferably in a spiral, from a connection 6c' to another connection 6c''.

The second half of the sleeve section 33' and the cover 72 form a heater, merely indicated by arrows 4', which is supplied with heat. The heat flow is indicated by the arrows 4', the heat flowing along the surface of the sleeve section 33' as far as an end wall 76 close to the cooler 6' and escapes there. In order to optimize heat transfer to the sleeve section 33' of the heater 4', a plurality of heat-conducting disks 56, which are surrounded by a jacket 58, are provided at an outer surface of the sleeve section 33'.

Figure 6:
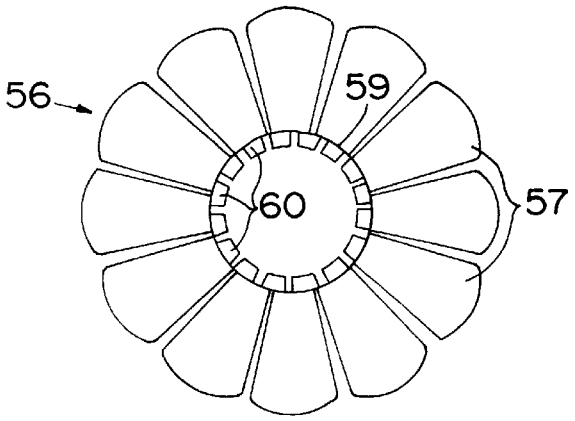
FIG. 6 shows a plan view of a heat-conducting disk.

According to FIG. 6, the heat-conducting disk 56 is provided with a circular ring 59 which, on its outside, has a plurality of ribbed blades 57, which are arranged next to one another, are arched slightly in a manner similar to turbine blades and are preferably composed of thermally conductive material. Formed in the heat-conducting disk 56 within the circular ring 59 are clamping strips 60 which can clamp them on the outer surface of the sleeve section 33' in a manner which allows them to be released again. The individual heat-conducting disks 56 are here slightly offset or rotated one above the other on the sleeve section 33' and thus form a large heat exchange surface, while the path of the heat flow through the heater is also lengthened.

Another essential point in this exemplary embodiment is that the annular space 34' is formed between the sleeve section 33' and the cylinder 3', said annular space 34' extending over the entire length of the cylinder 3' from the heater 4' to the cooler 6'. In this arrangement, an annular gap 67 is formed at one end and an annular gap 68 at the other between the cylinder 3' and the sleeve section 33'. A gas or the like can flow backwards and forwards through these annular gaps 67, 68.

In order to obtain optimum heat transfer from the cooler to the heater and from the sleeve section 33' to the cylinder 3', a plurality of plates 77 according to the invention are inserted in the longitudinal direction over the entire length of the annular space 34', from the annular gap 67 to the annular gap 68.

The plates 77 are designed in such a way that radial heat transfer is possible transversely to the sleeve section 33' and transversely to the cylinder wall 3' and, at the same time, a gas flows along in the longitudinal direction between the annular gap 67 and the annular gap 68, thereby making possible heat transfer from plates 77 to the gas by way of the large surface area.

Figure 7:
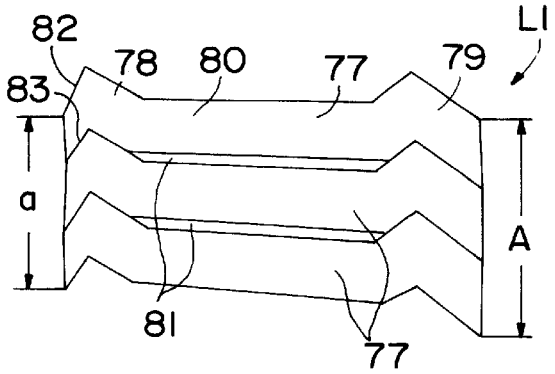
FIG. 7 shows a cross section through an arrangement of plates according to the invention.

FIG. 7 shows a plate arrangement $L_1$ according to the invention, it being possible for a plurality of plates 77, preferably of identical configuration, to be stacked one above the other. The special feature in the fact that it resides in the fact that it has a left-hand profile 78 and a right-hand profile 79. In between, these profiles 78 and 79 are connected to a strip 80. Profile 78 is preferably somewhat thinner than profile 79 since, when a number of plates 77 are laid one on top of the other, a smaller distance a is obtained overall on the side of the thinner profile 78 and a larger distance A on the side of the profile 79. It is thus possible, for example, to compensate for a radius of an annular space 34' and for the plates 77 to be matched to this radius.

The plates 77 are furthermore designed in such a way that, when laid one upon the other, a gap 81 is formed between individual plates 77, through which gap a gas or the like can be conveyed, for example.

The plates 77, which are preferably made from thermally conductive material, ensure good heat transfer by virtue of the significantly enlarged surface area.

The profiles 78, 79 of the plates 77 are preferably of triangular configuration, so that the shape of a triangle 82 situated on top coincides symmetrically with the shape of a triangle 83 underneath it and, as a result, it is possible to lay a plurality of plates one above the other or one on top of the other. However, other shapes for the profiles 78, 79 also lie within the scope of the invention.

The particular advantage of the plate arrangement $L_1$ is that manufacturing tolerances within an annular gap, for example, do not result in the individual plates being displaced in themselves and the gap 81 is thus held constant. A defined volume flow can thus be passed through the gap 81, the arrangement of the plates producing an extremely large heat exchange surface.

Figure 8:
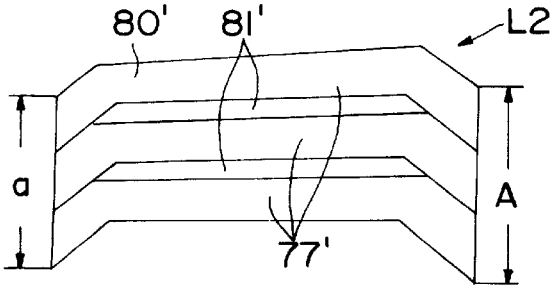
FIG. 8 shows another exemplary embodiment of the plates in FIG. 7.

In another exemplary embodiment in accordance with FIG. 8, a plate arrangement $L_2$ is shown which has plates 77' in a similar shape to that mentioned above, the thickness of the profiles 78', 79' of the plates 77' differing to the left and right of a strip 80' to allow them to adapt appropriately to a radius of an annular space 34'. Between the plates 77' there is likewise formed a gap 81' which is used to carry gases or the like.

Figure 9:
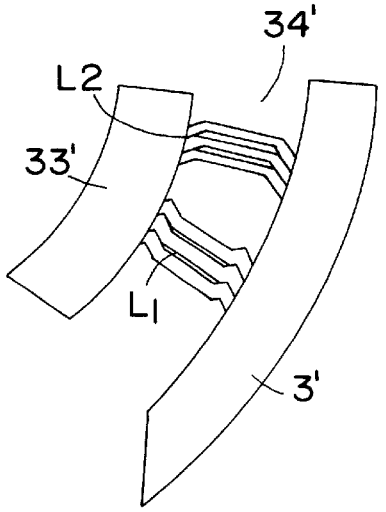
FIG. 9 shows a partial cross section of a plate arrangement after installation, along line IX—IX in FIG. 5.

FIG. 9 shows a partial cross section through the sleeve section 33', the cylinder 3' and the annular space 34' between them, into which plate arrangements $L_1$, $L_2$ can be inserted for heat transfer. Plate arrangement $L_1$ is preferably chosen since sliding apart is prevented by the profiles 78, 79. Plate 77 is furthermore simple and easy to manufacture and is formed from thermally conductive material. Thus, with these plates, it is thereby possible to fill the annular space 34' completely.

I claim:

1. Apparatus for operating and controlling a free-piston Stirling engine, which comprises: a cylinder; a displacement piston in said cylinder; a hot cylinder space of said cylinder separated from a cold cylinder space of said cylinder by said piston; a sleeve section surrounded by said cylinder; an annular space formed between the cylinder and said sleeve section; an annular gap adjacent said annular space in the region of the hot cylinder space and an annular gap adjacent said annular space in the region of the cold cylinder space; wherein the annular space extends from said annular gap in the region of the hot cylinder space to said annular gap in the region of the cold cylinder space; plates inserted into said annular space substantially all the way along said annular space in the longitudinal direction of said annular space.

2. Apparatus according to claim 1, wherein said plates are laid against one another in the annular space and a gap is formed between individual plates.

3. Apparatus according to claim 1, wherein said plates include a strip portion adjoining which at both ends there is a profile portion.

4. Apparatus according to claim 3, wherein one of said profile portions is made thinner than the other of said profile portions.

5. Apparatus according to claim 3, wherein said profile portions have a triangular contour.

6. Apparatus according to claim 1, wherein said annular space is completely filled with longitudinally arranged plates resting one upon the other, with an annular gap formed in the longitudinal direction between individual plates.

7. Apparatus according to claim 1, including an internal space in said displacement piston and a push rod connected to one side of the displacement piston, and a valve on said displacement piston on the same side as said push rod, said valve being operative to charge said internal space with maximum system pressure.

8. Apparatus according to claim 1, wherein said sleeve section has a cap at a first end thereof, said cap being provided with an inlet check valve and an outlet check valve.

9. Apparatus according to claim 8, wherein said sleeve section has a cover at a second end thereof opposed to said first end, and part of the sleeve section and of the cover forms a heater portion.

10. Apparatus according to claim 4, wherein that part of the sleeve section of the heater is provided on the outside thereof with a plurality of heat-conducting disks which are surrounded by a jacket.

11. Apparatus according to claim 10, wherein said heat-conducting disks have a plurality of ribbed blades arranged around a circular ring.

12. Apparatus according to claim 11, wherein said ribbed blades are of arched and blade-like design.

13. Apparatus according to claim 11, wherein the circular ring has a plurality of inwardly arranged clamping strips.

14. Apparatus according to claim 9, wherein a cooler is arranged around the sleeve section between the cap and heater portion.

15. Apparatus according to claim 14, wherein the cooler has cooling ribs which are arranged in a spiral around the sleeve section and are surrounded by a cooler casing.

16. Method of operating and controlling a free-piston Stirling engine, which comprises: providing a displacement piston in a cylinder; separating a hot cylinder space from a cold cylinder space by said piston; feeding a system pressure between the cold and hot cylinder space into a high-pressure reservoir as maximum value is exceeded and made up from a low pressure reservoir as a minimum value is undershot; using the pressure difference between the high pressure and low pressure reservoir to drive at least one of an energy converter, an auxiliary drive and a working piston, providing a sleeve section surrounding said cylinder and forming an annular space between the cylinder and sleeve section with an annular gap adjacent said annular space in the region of the hot cylinder space and an annular gap adjacent said annular space in the region of the cold cylinder space; and inserting plates into said annular space substantially all the way along said annular space in the longitudinal direction of said annular space.

17. Apparatus for operating and controlling a free-piston Stirling engine, which comprises: a cylinder; a displacement piston in said cylinder; a hot cylinder space of said cylinder separated from a cold cylinder space of said cylinder by said piston; a system pressure line connecting the hot cylinder space to the cold cylinder space; a pressure line leading from the system pressure line to a low pressure reservoir and a high pressure reservoir.

18. Apparatus according to claim 17, including a cooler inserted into the system pressure line following the cold cylinder space, and a heater inserted following the hot cylinder space, and a regenerator inserted between the cooler and the heater.

19. Apparatus according to claim 18, wherein the pressure line branches off from the system pressure line between the regenerator and the cooler.

20. Apparatus according to claim 18, wherein a cylinder for guiding the displacement piston is situated in a sleeve section, and with the sleeve section forms an annular space in which the regenerator is situated.

21. Apparatus according to claim 20, wherein the sleeve section and the cylinder are closed at one end by the heater and at the other end by a carrier with cooling devices.

22. Apparatus according to claim 21, wherein the heater is fitted with spirally extending plates in the direction of the displacement piston, which plates are covered by a disk.

23. Apparatus according to claim 22, wherein said disk has a central opening, and channels open between the plates into an annular conduit which is connected to the regenerator and the annular space.

24. Apparatus according to claim 21, wherein cooling coils are connected through the carrier to the annular space, on the one hand, and to the cold cylinder space, on the other hand.

25. Apparatus according to claim 21, wherein an annular gap is formed between the carrier and the cylinder in which a wall of the displacement piston slides.

26. Apparatus according to claim 17, wherein an inlet check valve is inserted into the pressure line in the direction of the high pressure reservoir, and an outlet check valve is inserted into said high pressure line in the direction of the low pressure reservoir.

27. Apparatus according to claim 17, wherein the high pressure reservoir is connected to an energy converter via a high pressure line, and the low pressure reservoir is connected to an energy converter via a low pressure line.

28. Apparatus according to claim 17, wherein the high pressure reservoir and the low pressure reservoir are connected by means of a valve to one of sides of an auxiliary drive and a working piston.

29. Apparatus according to claim 28, wherein said valve is a pneumatically controlled valve with a spool.

30. Apparatus according to claim 29, wherein the high pressure line and the low pressure line are each split into two pressure feed lines that supply the sides of the working piston with pressure and two pressure relieving low pressure return lines.

31. Apparatus according to claim 28, wherein the working piston has connected to it a shut-off slide which shuts off one of the pressure feed lines.

32. Apparatus according to claim 28, wherein an induction magnet is provided between two working pistons and a coil is associated with a cylinder for the working pistons.

* * * * *